US010448493B2

(12) United States Patent
Kent et al.

(10) Patent No.: US 10,448,493 B2
(45) Date of Patent: Oct. 15, 2019

(54) CONTROL OF DISCHARGE IN HIGH VOLTAGE FLUID INSULATION

(71) Applicant: SCHLUMBERGER TECHNOLOGY CORPORATION, Sugar Land, TX (US)

(72) Inventors: Christopher Todd Kent, Sugar Land, TX (US); Srinand Sreedharan Karuppoor, Sugar Land, TX (US); Anthony Frank Veneruso, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 371 days.

(21) Appl. No.: 15/131,782

(22) Filed: Apr. 18, 2016

(65) Prior Publication Data

US 2017/0303377 A1 Oct. 19, 2017

(51) Int. Cl.

| | |
|---|---|
| ***H05F 3/04*** | (2006.01) |
| ***E21B 47/00*** | (2012.01) |
| ***E21B 47/12*** | (2012.01) |

(52) U.S. Cl.

CPC ..... *H05F 3/04* (2013.01); *E21B 47/00* (2013.01); *E21B 47/12* (2013.01)

(58) Field of Classification Search

CPC ..... H05F 3/04; E21B 47/00; E21B 47/12

USPC ..... 361/231

See application file for complete search history.

(56) References Cited

U.S. PATENT DOCUMENTS 4,695,358 A * 9/1987 Mizuno ..... B01D 53/32 204/174

2012/0217406 A1* 8/2012 McGregor ..... G01T 3/00 250/361 R

FOREIGN PATENT DOCUMENTS

WO 2013/043311 A1 3/2013

OTHER PUBLICATIONS

Verzuh, Frank M., "Deionization Measurements of Grid-Controlled Thyratrons", MIT, Research Laboratory of Electronics, Technical Report No. 101, Mar. 8, 1949, 14 pages.

Anderson W.E. et al., "An International Comparison of High Voltage Capacitor Calibrations", IEEE Transactions on Power Apparatus and Systems, vol. PAS-97, No. 4 (Jul./Aug. 1979), pp. 1217-1223.

Jewel-Larsen, N.E, et al., "Modeling of Corona-Induced Electrohydrodynamic Flow with COMSOL Multiphysics", Proc. ESA Annual Meeting on Electrostatics (2008), 13 pages.

(Continued)

*Primary Examiner* — Kevin J Comber

(57) ABSTRACT

An instrument to produce ionizing radiation includes a high voltage source of charge and ionizing radiation; a housing filled with insulating gas and containing the high voltage source; an insulator to which the high voltage source is mounted so that the source is spaced from the housing; one or more collector electrodes arranged in the housing such that the high voltage source preferentially discharges to the collector electrode(s); a control system which determines a level of ionization of the insulating gas through the amount of discharge to the collector electrode(s); and/or discharge rate limiting means controllable by the control system to deionize the insulating fluid at a controlled discharge rate and thereby maintain the maximum rate of discharge below a predetermined current. In this way, breakdown events can be inhibited.

20 Claims, 4 Drawing Sheets

(56) References Cited

OTHER PUBLICATIONS https://en.wikipedia.org/wiki/Thyratron, 4 pages.
https://en.wikipedia.org/wiki/Corona_ring, 5 pages.
https://en.wikipedia.org/wiki/Arcing_horns, 4 pages.
https://en.wikipedia.org/wiki/Ionization_chamber, 8 pages.
https://en.wikipedia.org/wiki/Voltage-regulator_tube, 4 pages.

* cited by examiner

CONTROL OF DISCHARGE IN HIGH VOLTAGE FLUID INSULATION

FIELD OF THE INVENTION

The present invention relates to a control system for limiting charge accumulation in high voltage fluid insulation, and to the use of such a control system in the context, for example, of an instrument which produces ionizing radiation.

BACKGROUND

Certain instruments, for example well-logging instruments such as pulsed neutron devices and x-ray emitting devices, require the use of very high voltages within relatively small and confined spaces, in the presence of ionizing radiation and typically at high temperatures. In such instruments, the components operated at high voltage are located near ground potential components, such as the instrument housing. The high voltage operated components and the ground potential components are electrically isolated from each other using insulation that can occupy a tightly confined space. FIG. 1 shows schematically an instrument having a high voltage, charge and ionizing radiation source 201, and an insulator 202 on which the charge and ionizing radiation source is mounted. The source and insulator are located in a housing 203, with a gas-insulated gap 204 spacing the source from the housing. The high voltage, charge and ionizing radiation can derive from separate elements within the source.

The source 201 causes ionization events in the insulating gas. In the gas, the high electric field produced by the voltage difference between the source and the housing 203 causes positive ions and electrons to flow in opposite directions; either to the outer surface of the source or to the inner surface of the housing. Destructive and uncontrolled arcing or voltage breakdown 205 between the source and the housing can then result.

SUMMARY

It would be desirable to increase the useful lifetime of such instruments by eliminating or reducing the occurrence of uncontrolled arcing.

Accordingly, in a first aspect, the present invention provides an instrument which produces ionizing radiation, the instrument including:

- a high voltage source of charge and ionizing radiation;
- a housing filled with insulating fluid and containing the high voltage source; and
- an insulator to which the high voltage source is mounted so that the source is spaced from the housing;
- wherein the instrument further includes:
- one or more collector electrode(s) arranged in the housing such that the high voltage source preferentially discharges to the collector electrode(s);
- a control system which determines a level of ionization of the insulating fluid through the amount of discharge to the collector electrode(s); and
- discharge rate limiting means controllable by the control system to deionize the insulating fluid at a controlled discharge rate and thereby maintain the maximum rate of discharge below a predetermined current.

In this way, by deionizing the insulating fluid at a controlled discharge rate, destructive discharges (such as uncontrolled arcing or other breakdown events) having rates of discharge above the predetermined current may be inhibited.

In a second aspect, the present invention provides a control system for use in the instrument of the first aspect. For example, a control system can be provided for controlling deionization in an instrument which produces ionizing radiation, the instrument including: a high voltage source of charge and ionizing radiation, a housing filled with insulating fluid and containing the high voltage source; an insulator to which the high voltage source is mounted so that the source is spaced from the housing, one or more collector electrode(s) arranged in the housing such that the high voltage source preferentially discharges to the collector electrode(s), and discharge rate limiting means; wherein the control system is configured to determine a level of ionization of the insulating fluid through the amount of discharge to the collector electrode(s), and control the discharge rate limiting means to deionize the insulating fluid at a controlled discharge rate and thereby maintain the maximum rate of discharge below a predetermined current.

In a corresponding third aspect, the present invention provides a method for controlling deionization including:

- providing an instrument which produces ionizing radiation, the instrument including a high voltage source of charge and ionizing radiation, a housing filled with insulating fluid and containing the high voltage source; an insulator to which the high voltage source is mounted so that the source is spaced from the housing, one or more collector electrode(s) arranged in the housing such that the high voltage source preferentially discharges to the collector electrode(s), and discharge rate limiting means;
- determining a level of ionization of the insulating fluid through the amount of discharge to the collector electrode(s); and
- controlling the discharge rate limiting means to deionize the insulating fluid at a controlled discharge rate and thereby maintain the maximum rate of discharge below a predetermined current.

Optional features of the invention will now be set out. These are applicable singly or in any combination with any aspect of the invention.

The discharge rate limiting means may be further controllable by the control system to deionize the insulating fluid at a controlled location.

The discharge rate limiting means can include an electrical circuit which varies an electrical bias applied to the collector electrode(s) relative to the high voltage source to encourage deionization of the insulating fluid at the collector electrode(s). For example, the electrical circuit can include one or more variable resistors which vary a leakage current to ground through the collector electrode(s).

The collector electrode(s) may be spaced from the high voltage source by a gap which is filled by the insulating fluid.

The collector electrode(s) may be mounted directly to the source, or may be mounted at a specified conformal offset from the high voltage source.

The insulating fluid may be a dielectric gas; for example, pressurised sulphur hexafluoride ($SF_6$), pressurized nitrogen ($N_2$), or a mixture of such dielectric gases. The insulating fluid can be a liquid; for example, mineral oil, a silicone-based oil, or a pentaerythritol ester based oil (see e.g. WO 2013/043311, herein incorporated by reference), typically used in high voltage transformers. The insulating fluid may be pressurised.

The collector electrode(s) may be formed of conductive, semiconductive and/or insulative layers.

The housing may have an electrically insulative layer lining the inner surface thereof.

The housing may have a passive semiconductive layer lining its inner surface as a discharge control element. Another option, however, is for the discharge rate limiting means to include an actively-controlled semiconductive layer lining the inner surface of the housing as a discharge control element.

The discharge rate limiting means may include a fluid circulator which is actively controllable by the control system to circulate the insulating fluid within the housing to preferentially encourage discharge of the insulating fluid at the collector electrode(s). Additionally or alternatively, the instrument may further include a passive fluid circulator that is not under the control of the control system but which circulates the insulating fluid within the housing to preferentially encourage discharge of the insulating fluid at the collector electrode(s).

For example, an active or passive fluid circulator can include one or more mechanical pumps or blowers. These can be of rotatable impeller type. Another option, however, is to adopt impellers based on piezoelectric resonant surfaces. Such surfaces can be located face-to-face with a small gap therebetween, and also serve as charge collection surfaces.

Additionally or alternatively, an active or passive fluid circulator can include one or more electrohydrodynamic convectors. The ionized insulating fluid can be made to circulate within the housing by such a convector by control of an electrical field applied across the fluid.

Typically, the housing defines a closed volume which is filled with the insulating fluid. This the insulating fluid is typically not replenished or replaced during operation.

The instrument may be a well logging instrument, such as a wireline, coiled tubing, measuring-while-drilling or logging-while-drilling instrument.

BRIEF DESCRIPTION OF THE DRAWINGS

Embodiments of the invention will now be described by way of example with reference to the accompanying drawings in which.

DETAILED DESCRIPTION AND FURTHER OPTIONAL FEATURES

The ensuing description provides preferred exemplary embodiment(s) only, and is not intended to limit the scope, applicability or configuration of the invention. Rather, the ensuing description of the preferred exemplary embodiment(s) will provide those skilled in the art with an enabling description for implementing a preferred exemplary embodiment of the invention, it being understood that various changes may be made in the function and arrangement of elements without departing from the scope of the invention. Thus although described below in respect of a well-logging instrument, the invention may also have, for example, nuclear, medical, other industrial and defense applications.

Specific details are given in the following description to provide a thorough understanding of the embodiments. However, it will be understood by one of ordinary skill in the art that embodiments may be practiced without these specific details. For example, well-known circuits, processes, algorithms, structures, and techniques may be shown without unnecessary detail in order to avoid obscuring the embodiments.

Figure 1:
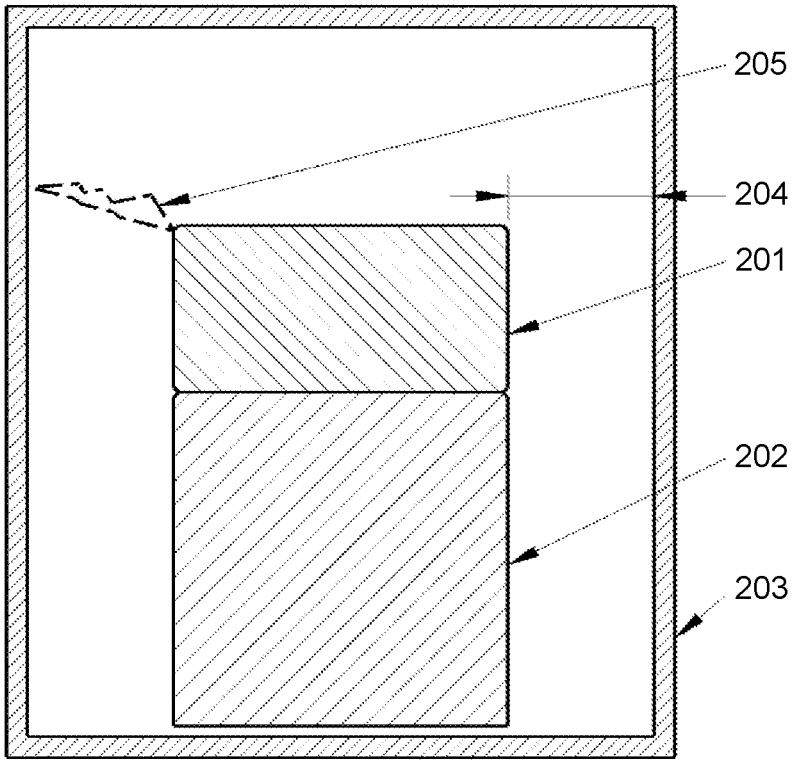
FIG. 1 shows schematically an instrument having a high voltage, charge and ionizing radiation source.
Figure 2:
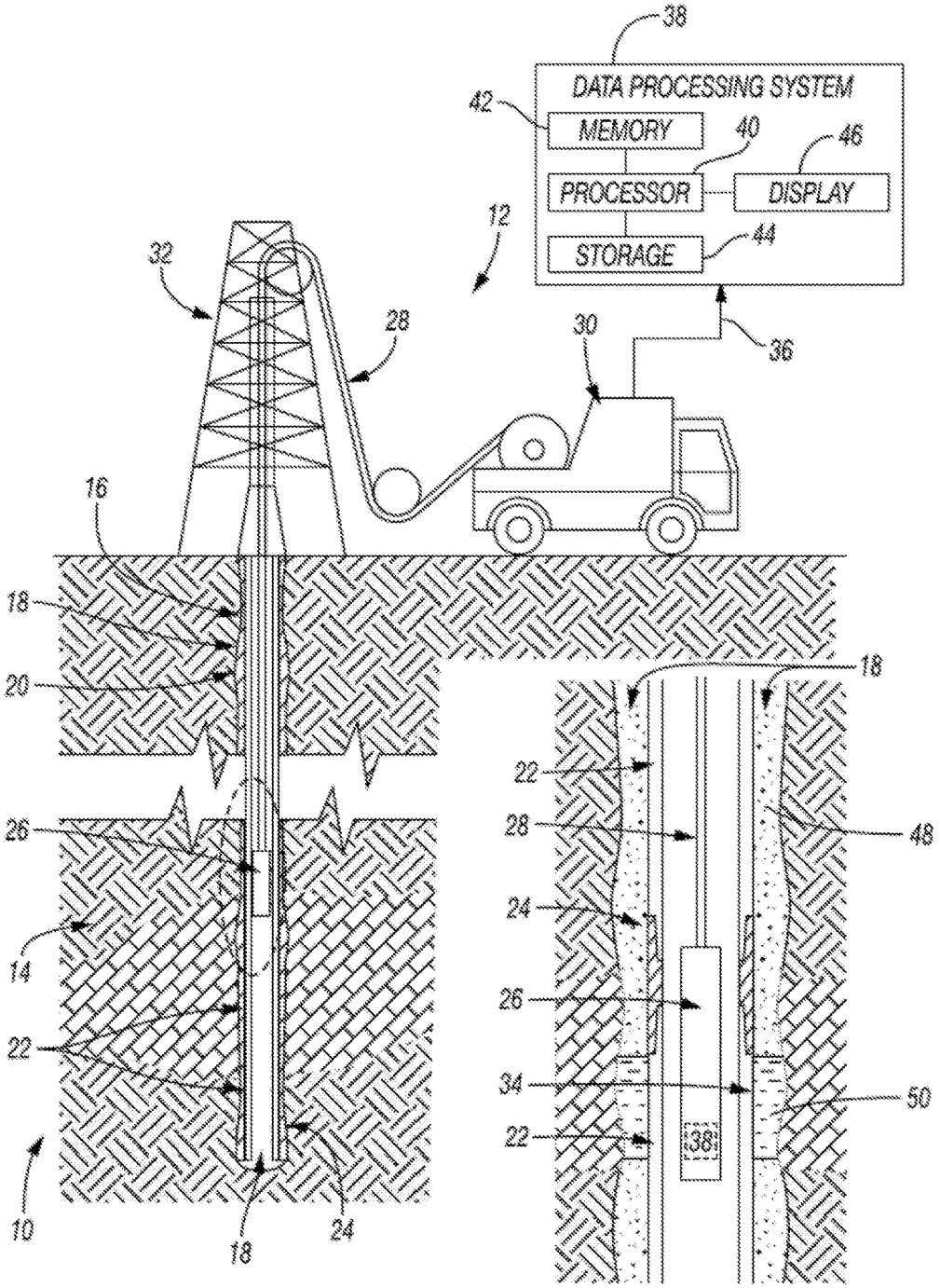
FIG. 2 schematically illustrates an example system for evaluating a well.

FIG. 2 schematically illustrates an example system 10 for evaluating a well. In particular, FIG. 2 illustrates surface equipment 12 above a geological formation 14. In the example of FIG. 2, a drilling operation has previously been carried out to drill a wellbore 16. In addition, an annular fill 18 has been used to seal an annulus 20 (the space between the wellbore 16 and casing joints 22 and collars 24) with cementing operations.

As seen in FIG. 2, several casing joints 22 (also referred to below as casing 22) represent lengths of pipe that are coupled together by the casing collars 24 to form a casing string which stabilizes the wellbore 16. The casing joints 22 and/or collars 24 may be made of carbon steel, stainless steel, or other suitable materials to withstand a variety of forces, such as collapse, burst, and tensile failure, as well as chemically aggressive fluid.

The surface equipment 12 may carry out various well logging operations to detect conditions of the wellbore 16. The well logging operations may measure parameters of the geological formation 14 (e.g., resistivity or porosity) and/or the wellbore 16 (e.g., temperature, pressure, fluid type, or fluid flowrate). Other measurements may provide acoustic cement evaluation and well integrity data (e.g., casing thickness, apparent acoustic impedance, drilling fluid impedance, etc.) that may be used to verify the cement installation and the zonal isolation of the wellbore 16. One or more logging tools 26 may obtain some of these measurements.

The example of FIG. 2 shows the logging tool 26 being conveyed through the wellbore 16 by a wireline cable 28. Such a cable 28 may be a mechanical cable, an electrical cable, or an electro-optical cable that includes a fiber line protected against the harsh environment of the wellbore 16. In other examples, however, the logging tool 26 may be conveyed using any other suitable conveyance, such as coiled tubing. In some embodiments, drilling fluid or mud 25 may be present around the logging tool 26 as it is conveyed in the wellbore 16.

The wireline logging tool 26 may be deployed inside the wellbore 16 by the surface equipment 12, which may include a vehicle 30 and a deploying system such as a drilling rig 32. Data related to the geological formation 14 or the wellbore 16 gathered by the logging tool 26 may be transmitted to the surface, and/or stored in the logging tool 26 for later processing and analysis. The vehicle 30 may be fitted with or may communicate with a computer and software to perform data collection and analysis.

FIG. 2 also schematically illustrates a magnified view of a portion of the cased wellbore 16. When the logging tool 26 provides measurements to the surface equipment 12 (e.g., through the wireline cable 28), the surface equipment 12 may pass the measurements as data 36 to a data processing system 38 that includes a processor 40, memory 42, storage 44, and/or a display 46. In other examples, the data 36 may be processed by a similar data processing system 38 at any other suitable location. For example, in some embodiments, all or a portion of data processing may be performed by a data processing system 38 in the logging tool 26 or near the logging tool 26 downhole.

Figure 3:
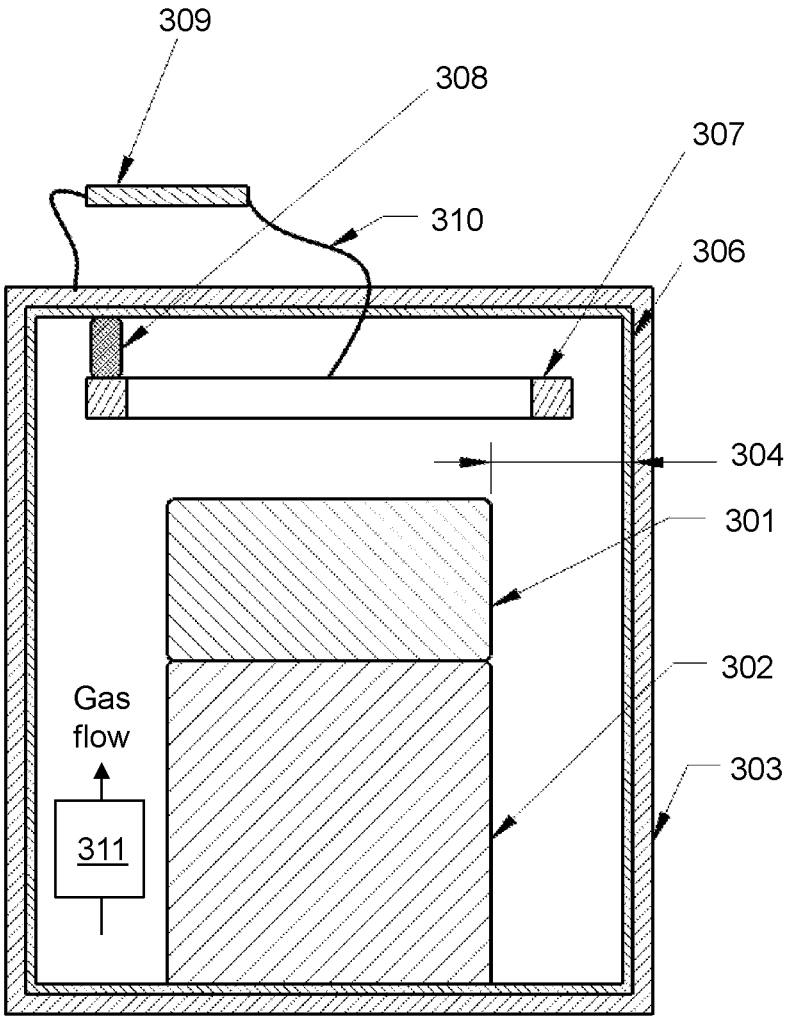
FIG. 3 shows schematically an instrument from a wireline logging tool of FIG. 2, the instrument having a high voltage, charge and ionizing radiation source.

FIG. 3 schematically shows an instrument from the wireline logging tool 26. The instrument has a high voltage, charge and ionizing radiation source 301, and an insulator 302 on which the charge and ionizing radiation source is mounted. The source and insulator are located in a housing 303, with a gas-insulated gap 304 spacing the source from the housing. The housing defines a closed volume for an insulating gas, which can be, for example, pressurised $SF_6$, pressurized $N_2$, or other dielectric gases.

The instrument also has a collector electrode 307 supported in the housing by an insulative support 308, and typically appropriately biased relative to the high voltage source 301, so that the source preferentially discharges to the electrode. An electrical control system 309 connected to the electrode by wiring 310 determines the level of ionization of the insulating gas through the amount of discharge to the collector electrode. Based on the determined level, discharge rate limiting means controllable by the control system can be used to allow charge leakage from the gas at a controlled discharge rate, and thereby avoid destructive, high current discharges, such as uncontrolled arcing. Advantageously, this controlled deionization may be automatic and continuous. Isolation design (for example, optional electrically insulative layer 306 discussed below) of surrounding equipment may be applied to create a preferential leak path through the electrode and control system circuit.

As an example of such discharge rate limiting means, the control system can control circulation (i.e. natural or forced convection) of the neutral and charge laden gas in the closed volume of the housing 303 via a fluid circulator 311. This can include, for example, one or more rotatable impeller or piezoelectric blowers. Additionally or alternatively, voltage biasing can enhance the circulation. Thus the fluid circulator 311 can include one or more electrohydrodynamic (EHD) convectors (see, for example, N. E. Jewell-Larsen et al., *Modelling of corona-induced electrohydrodynamic flow with COMSOL Multiphysics*, ESA Annual Meeting on Electrostatics, 2008—herein incorporated by reference).

As another example, the control system 309 can include an electrical circuit which varies an electrical bias applied to the collector electrode 307 relative to the high voltage source 301 to encourage discharge of the insulating fluid at the collector electrode. In particular, the electrical circuit can include a variable resistor which varies a leakage current to ground through the collector electrode.

Preferably, some or all of these approaches (natural convection, forced convection, and EHD enhanced convection) can be used together to discharge the gas at a controlled location and rate. The choice and configuration of the approaches may also need to take into account the possible orientations of the instrument of the wireline logging tool 26 with regard to gravity.

Thus by reliable control and monitoring of the ionization level of the gaseous insulator the concentration of space charge within the dielectric gas can be reduced, enabling continuous long-life reliable operation of the instrument where electrical arc breakdown of the gaseous insulator would otherwise occur.

One or more further collector electrodes (not shown) may be arranged in the housing. The control system can then also determine the level of ionization of the insulating gas through the amount of discharge to the further collector electrodes. Having plural collector electrodes can enhance charge collection. They can also be used to stimulate electrohydrodynamic flow therethrough.

The design of the (or each) collector electrode 307 can be used to enhance the actively controlled or passive discharge of the gaseous insulator, such that destructive discharges are inhibited. For example, relevant design considerations are sharp edges versus controlled radii, relative position from the high voltage source 301, and electrical field shaping. In this way control can be exerted over where deionization occurs and charge is collected.

Location of discharge can also be controlled by the control system 309. For example, by extending the effective breakdown path to ground, streamers or other breakdown structures can be inhibited. Such control can be achieved by modulating the flow of the insulating fluid in time e.g. to take advantage of eddy mixing to effectively chop charge loaded streamlines into segments that will not support breakdown. In a passive system, resonating structures may be used to modulate the flow.

The housing 303 may have an electrically insulative layer 306 which lines its inner surface. This can further help to create a preferential path for discharge to the collector electrode 307. Organic (e.g. polymeric) or inorganic (e.g. ceramic, glass) insulators may be used to form the insulative layer.

Additionally or alternatively, the housing 303 may have a passive or actively-controlled semiconductive layer (not shown) lining its inner surface as a discharge control element.

The control system circuitry and wiring 310 may be external to or contained within the housing 303. The wiring may be a structural element of the instrument, e.g. supplementing the insulative support 308.

Figure 4:
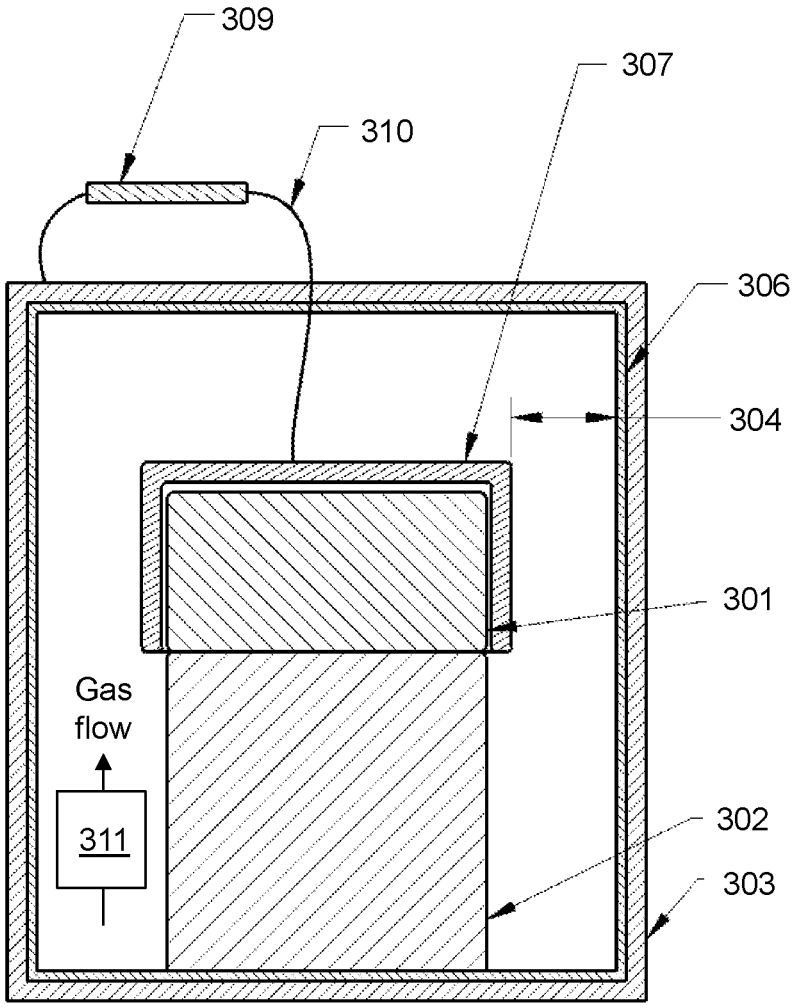
FIG. 4 shows schematically a variant of the instrument of FIG. 3.

FIG. 4 shows schematically a variant of the instrument of FIG. 3. In this variant, the collector electrode 307 is mounted directly to the high voltage source 301, or is mounted at a specified conformal offset from the high voltage source. In this way, it additionally limits or directs charge injection from exposed surfaces of the high voltage source 301. The collector electrode is formed as a cap which wholly or partially surrounds the exposed surface of the source. It may be composed of nested conductive, semiconductive, and or insulative layers.

In other variants, the housing 303 may contain an insulating liquid (such as mineral oil, a silicone-based oil, or a pentaerythritol ester based oil) rather than an insulating gas. The fluid circulator 311 can then be adapted accordingly.

What is claimed is:

1. An instrument for producing ionizing radiation, the instrument comprising:

a high voltage source of charge and ionizing radiation;

a housing filled with insulating fluid and containing the high voltage source;

an insulator to which the high voltage source is mounted so that the source is spaced from the housing;

at least one collector electrode arranged in the housing such that the high voltage source preferentially discharges to the at least one collector electrode;

a control system for determining a level of ionization of the insulating fluid through an amount of discharge to the at least one collector electrode; and discharge rate limiting means controllable by the control system to deionize the insulating fluid at a controlled discharge rate and thereby maintain a maximum rate of discharge below a predetermined current.

2. The instrument according to claim 1, wherein the discharge rate limiting means is further controllable by the control system to deionize the insulating fluid at a controlled location.

3. The instrument according to claim 1, wherein the discharge rate limiting means includes an electrical circuit which varies an electrical bias applied to the at least one collector electrode relative to the high voltage source to encourage deionization of the insulating fluid at the at least one collector electrode.

4. The instrument according to claim 1, wherein the discharge rate limiting means includes a fluid circulator which is actively controllable by the control system to circulate the insulating fluid within the housing to preferentially encourage discharge of the insulating fluid at the at least one collector electrode.

5. The instrument according to claim 1, wherein the instrument further includes a passive fluid circulator that is not under the control of the control system but which circulates the insulating fluid within the housing to preferentially encourage discharge of the insulating fluid at the at least one collector electrode.

6. The instrument according to claim 1, wherein the at least one collector electrode is spaced from the high voltage source by a gap which is filled by the insulating fluid.

7. The instrument according to claim 1, wherein the at least one collector electrode is mounted directly to the high voltage source, or is mounted at a specified conformal offset from the high voltage source.

8. The instrument according to claim 1, wherein the insulating fluid is pressurised.

9. The instrument according to claim 1, wherein the at least one collector electrode is formed of conductive layers, semiconductive layers, and/or insulative layers.

10. The instrument according to claim 1, wherein the housing has an electrically insulative layer lining the inner surface thereof.

11. The instrument according to claim 1, wherein the housing has a passive or actively-controlled semiconductive layer lining its inner surface as a discharge control element.

12. The instrument according to claim 1, which is a well logging instrument.

13. A control system for controlling deionization in an instrument which produces ionizing radiation, the instrument including:

a high voltage source of charge and ionizing radiation, a housing filled with insulating fluid and containing the high voltage source;

an insulator to which the high voltage source is mounted so that the source is spaced from the housing, at least one collector electrode arranged in the housing such that the high voltage source preferentially discharges to the at least one collector electrode, and discharge rate limiting means;

wherein the control system is configured to: determine a level of ionization of the insulating fluid through an amount of discharge to the at least one collector electrode, and control the discharge rate limiting means to deionize the insulating fluid at a controlled discharge rate and thereby maintain a maximum rate of discharge below a predetermined current.

14. A method for controlling deionization including:

providing an instrument which produces ionizing radiation, the instrument including a high voltage source of charge and ionizing radiation, a housing filled with insulating fluid and containing the high voltage source; an insulator to which the high voltage source is mounted so that the source is spaced from the housing, at least one collector electrode arranged in the housing such that the high voltage source preferentially discharges to the at least one collector electrode, and discharge rate limiting means;

determining a level of ionization of the insulating fluid through an amount of discharge to the at least one collector electrode; and controlling the discharge rate limiting means to deionize the insulating fluid at a controlled discharge rate and thereby maintain a maximum rate of discharge below a predetermined current.

15. The method according to claim 14, wherein the discharge rate limiting means is further controlled to deionize the insulating fluid at a controlled location.

16. The method according to claim 14, wherein the discharge rate limiting means includes an electrical circuit which is controlled to vary an electrical bias applied to the at least one collector electrode relative to the high voltage source to encourage deionization of the insulating fluid at the at least one collector electrode.

17. The method according to claim 14, wherein the discharge rate limiting means includes a fluid circulator which is controlled to circulate the insulating fluid within the housing to preferentially encourage discharge of the insulating fluid at the at least one collector electrode.

18. The method according to claim 14, wherein the at least one collector electrode is spaced from the high voltage source by a gap which is filled by the insulating fluid.

19. The method according to claim 14, wherein the at least one collector electrode is mounted directly to the high voltage source, or is mounted at a specified conformal offset from the high voltage source.

20. The method according to claim 14, wherein the insulating fluid is pressurised.

* * * * *